United States Patent [19]

Pieper et al.

[11] 4,124,674

[45] Nov. 7, 1978

[54] PROCESS FOR REMOVING RESIDUAL SOLVENT FROM DRY-SPUN FILAMENTS

[75] Inventors: Christian Pieper, Neuss; Hans Uhlemann, Solingen; Karlheinz Feltgen, Dormagen; Klaus Nickel, Dormagen; Alfred Nogaj, Dormagen; Günter Lorenz, Dormagen, all of Germany

[73] Assignee: Bayer Aktiengesellschaft, Leverkusen, Germany

[21] Appl. No.: 723,581

[22] Filed: Sep. 15, 1976

[30] Foreign Application Priority Data

Sep. 17, 1975 [DE] Fed. Rep. of Germany ..... 2541335

[51] Int. Cl.[2] ..... D01F 6/18

[52] U.S. Cl. ..... 264/233; 82/137.5; 68/5 R; 264/206

[58] Field of Search ..... 8/117.5; 264/38, 290 R, 264/206, 233; 68/5

[56] References Cited

U.S. PATENT DOCUMENTS

| | | | |
|---|---|---|---|
| 3,241,343 | 3/1966 | Yazawa | 264/290 R |
| 3,961,890 | 6/1976 | Brusa et al. | 264/38 |

*Primary Examiner*—Jay H. Woo

*Attorney, Agent, or Firm*—Plumley and Tyner

[57] ABSTRACT

The invention relates to a process for continuously removing residual solvent from filaments of dry-spun acrylonitrile polymers to values of below 2% by weight of solvent by a multi-stage hot-wash with low quantities of water.

6 Claims, 2 Drawing Figures

PROCESS FOR REMOVING RESIDUAL SOLVENT FROM DRY-SPUN FILAMENTS

Figure 1:
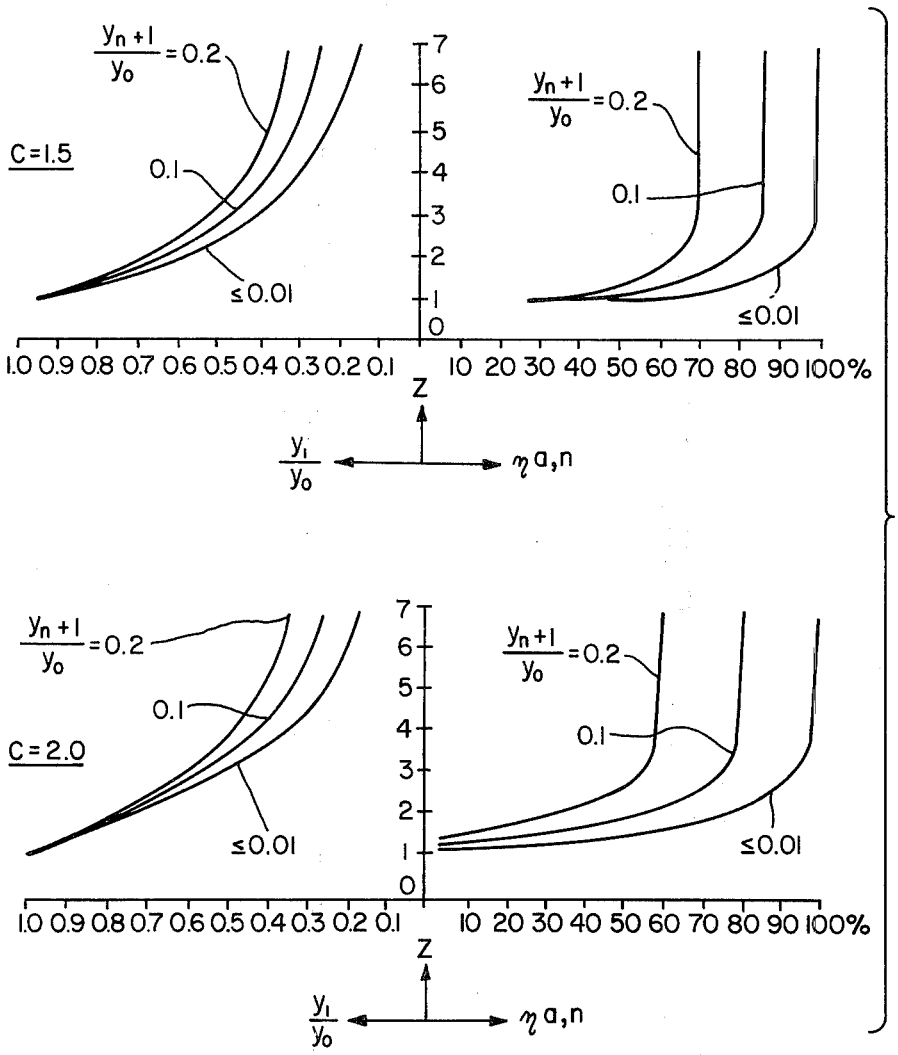

This invention relates to a process for the continuous removal of solvent from dry-spun acrylonitrile filaments by washing with water to values of below 2% by weight.

Filaments of polyacrylonitrile or copolymers of acrylonitrile with other olefinically unsaturated monomers, which are dry-spun from solvents by conventional methods, generally contain from 5 to 40% by weight of residual solvent, based on the dry polymer, on completion of the spinning process.

As already known, the residual solvent is removed before, during or after drawing, generally by extraction with water. To this end, tows are passed through several tanks in which the washing liquid flows in countercurrent to the tows. Unfortunately, it has not yet been possible with washing units of this kind to lower the residual solvent content to values of below 2% without unreasonably long residence times of the filaments in the washing solution being required for continuous operation (which leads either to long washing zones or to low two speeds) or without considerable quantities of water being used for washing and having to be worked up again afterwards.

It is known that fibres with a good dyeing uniformity can be obtained by reducing the residual solvent content to values of below 2.5% before drawing. It is also known that high-shrinkage fibres can be obtained by intensively removing the solvent before drawing. The processes used for removing the solvent to such low contents as these are attended either by the disadvantage that they have to be carried out in batches with fairly lengthy residence times in the washing solution, or by the disadvantage that the fibres are steamed or dried after washing.

Accordingly, it is an object of the present invention to provide a continuous washing process. It is another object to provide a washing process, wherein the solvent content of dry-spun acrylonitrile polymer fibres can be reduced to values of below 2%. Still a further object is to provide a washing process, wherein the quantity of washing water used is as small as possible.

These objects are accomplished by a process for continuously removing residual solvent from filaments of dry-spun acrylonitrile polymers to values of below 2% by weight of solvent, based on the dry filament material, which comprises washing the filaments in stages with a quantity of from 0.5 to 2.5 parts by weight of water per part by weight of the dry filament material, the water being at a temperature of at least 80° C., and the washing being carried out in countercurrent for at least 30 seconds.

It has been found that generally at least 6 washing stages are required for reducing the residual solvent content to values of below 2% by weight if it is desired to adjust the consumption of water to between 0.5 to 2.5 parts by weight per part by weight of the filament material. On the other hand, no significant additional washing effect is obtained with the same quantity of water in cases where washing is carried out over more than 24 stages.

Accordingly, the process according to the invention is preferably carried out with from 6 to 24 washing stages.

It is of course not necessary for every washing stage to be carried out at the minimum temperature specified. All that is important is that the filament material should be washed for at least 30 seconds with water at a temperature of at least 80° C. during the washing process as a whole. This hot wash may be preceded or followed, preferably preceded, by a single-stage or multistage cold wash. In the context of the invention, a cold wash is a wash carried out with water at a temperature of below about 50° C.

As already mentioned, a primary object of the invention is to minimise the consumption of water during washing by comparison with conventional processes. A low water consumption is important for economic reasons, because all the water left after washing has to be evaporated in order to recover the solvent.

The consumption of water in the process according to the invention may be kept at the low levels indicated, especially if the filament material is demoistened between the individual washing stages. For example, it has been found that, with a total of 12 washing stages, with a deposition of more than 90% of the solvent situated primarily on the surface of the fibres and with a cold wash, the consumption of washing water is proportional to the quantity of moisture adhering to the fibres, i.e. not removed, after each stage. If, for example, the actual hot wash is preceded by from 6 to 9 stages of cold washing, followed by 6 stages of hot washing, the dimethyl formamide(DMF)-content in the two falls to 5 to 10% in the first cold stages almost independently of temperature up to a level of 50° C. This value undergoes hardly any change when the tow speed changes. However, it is governed to a considerable extent by the degree of demoistening between the individual stages and the quantity of water consumed. If further stages are available, the consumption of water can be reduced for otherwise the same deposition and demoistening levels, temperature and residence time.

Demoistening is best carried out by squeezing, for example by squeezing rolls. The process according to the invention may be carried out with particular effect by removing from 30 to 70% by weight of the moisture entrained by the filaments by squeezing out before the next washing stage.

In a particularly preferred embodiment of the process, therefore, the filament material is washed over 6 to 24 stages, the moisture content of the filaments being reduced by 30 to 70% by squeezing out between the individual stages.

As already mentioned, hot washing is essential for obtaining residual solvent contents in the filaments of 2% and less. It has been found that residence times of the filaments of more than 300 seconds in hot washing baths at 100° C. have no significant additional effect. In this connection, it will be clear to the expert that, within the context of the invention and to obtain the required result, the temperature of the hot washing solution, which for reasons of pollution should not exceed 100° C., and the treatment time are not independent of one another. Thus, the necessary treatment time increases with falling temperature, roughly to twice its nominal length for every 10° C.

The treatment time, i.e. the residence time of the filament material in the hot washing solution, may be controlled in two ways: (1) through the rate of travel of the tow and (2) through the particular length of the bath. Since, in addition, it has been found that the result according to the invention can be obtained under substantially the same conditions, such as temperature, number of stages, squeezing out, water consumption and tow speed, and both with drawn and with undrawn filament material, different variations are possible in regard to the residence times. Accordingly, it is necessary, for example, for a washing installation after drawing to be longer by about the drawing factor than a washing installation before drawing, or for the speed or travel of the tow where washing is carried out after drawing to be lower by about the drawing factor than the speed of travel of the tow where washing is carried out before drawing. Drawing can, of course, also be carried out during washing.

In general, the tows are washed at speeds of travel of up to 60 meters per minute where washing is carried out before drawing, although they may be washed at even higher speeds of travel. The tow is best transported by means of rollers. In the individual washing stages, a mixing effect is obtained either by the movement of the tow or by means of additional mixing units.

Since the process according to the invention is a continuous process, it is only the overall balance of fresh water introduced and washing solution run off which is of interest for determining the quantity of water consumed during washing. The quantity of washing agent present in the individual stages (the washing agent may be fresh water or even a mixture of solvent and water to begin with) may be disregarded. However, this washing-agent reservoir should be kept as small as possible, optionally by the addition of filling elements, to enable the equilibrium condition corresponding to continuous operation to be adjusted as quickly as possible.

It has also been found, in accordance with the invention, that the effect of the denier, the spinning conditions and the composition of the polymer on the washing conditions, such as temperature, number of stages, squeezing out, water consumption and residence time, is only negligible so that the process according to the invention is in no need of variation in this respect.

In order to check the washing conditions for any dependence upon the drawing ratio, filaments of 93.6% by weight of acrylonitrile, 5.7% by weight of methyl acrylate and 0.7% by weight of sodium methallyl sulphonate were dry-spun from dimethyl formamide on a laboratory scale. Specimens of the spun material were then drawn in a ratio of 1:2, 1:3, 1:4 and 1:5, and also left undrawn. The filament material was washed with 500 liters of water per g of filament material at a temperature of 100° C. It was found that, in every case, washing had to be carried out for between about 40 and 50 seconds in order to lower the residual solvent content to around 1.5%. Accordingly, the washing process may be regarded as being independent of the drawing ratio.

In order to investigate the influence of denier, the washing times required for reducing the solvent content to around 2% were determined in a similar test at a washing water temperature of 90° C. The following times were measured:

Table 1

| Denier (dtex) | Time (secs) |
|---|---|
| 9 | 42 |
| 18 | 42 |
| 34 | 36 |

Accordingly, the influences of denier are surprisingly minimal.

In another series of tests, the influence of the polymer composition was investigated. To this end, the following times were required in order to reduce to 2% the DMF-content in filaments with a spinning denier of 9 dtex:

Table 2

| Polymer | Time (secs) |
|---|---|
| 93.6 % ACN, 5.7 % AME, 0.7 % MAS | 42 |
| 91 % ACN, 5.7 % AME, 3.4 % MAS | 25 |
| 60 % ACN, 37 % $VCl_2$, 3 % MAS | 25 |
| ACN = acrylonitrile | |
| AME = methyl acrylate | |
| $VCl_2$ = vinylidene chloride | |
| MAS = sodium salt of methallyl sulphonic acid | |

Although, in this case, much more distinct differences occur in the washing times required, it can nevertheless be said that the washing conditions are substantially independent of the polymer composition because the differences found have comparatively little effect in relation to the influences of washing temperature, degree of squeezing out, etc.

Accordingly, it is possible by the process according to the invention to treat acrylic filaments, such as modacrylic filaments, i.e. filaments of polymers containing 50% by weight, preferably 85% by weight, and more of acrylonitrile and up to 50% by weight, preferably 15% by weight, of other copolymerised, ethylenically unsaturated monomers such as, for example, acrylic acid or methacrylic acid esters such as methyl acrylate, ethyl acrylate, methyl methacrylate, vinyl esters such as vinyl acetate, vinyl halides, such as vinyl chloride, vinylidene chloride and vinyl bromide, acrylic acid amides such as acrylamide, N,N-dimethyl acrylamide and monomers containing ionisable groups, preferably acid groups, such as for example allyl sulphonic acid, methallyl sulphonic acid, vinyl sulphonic acid, styrene sulphonic acid, acrylic acid, methacrylic acid and their salts.

Tows washed in accordance with the invention before drawing require slightly higher forces for drawing than tows still containing relatively large quantities of solvent. For example, the strain applied by drawing in a ratio of 1:4 in water at 90° C. increases from about 0.07 p/dtex in the case of spun material containing about 5% of DMF to approximately 0.09 p/dtex in the case of spun material from which the DMF has been removed to a residual content of less than 2%. This means that the drawing rollers have to be made 30% stronger for washing in accordance with the invention. However, this is not regarded as a disadvantage because it has been found that fibres of tows subjected to the higher drawing levels also show greater fibre strengths and fibre elongations.

It has also been found that fibres washed before drawing to a DMF content of less than 2%, subsequently drawn at 75° to 100° C., finished, dried at 145° C. with allowance for shrinkage and then steamed, contain very few vacuoles, i.e. have a stable lustre, both before and after boiling. They have densities of more than 1.180 g/cc both before and after boiling. Allowing shrinkage in the dryer is important both in regard to the lustre stability and in regard to the high density.

In another, particularly preferred embodiment of the process according to the invention, the hot wash is carried out in a closed system. In this way, it is possible to reduce the emission of solvent to a minimum. For the same reason, it is advantageous to divide the washing process as a whole into a cold wash preceding the actual hot wash, in which parts of the solvent are actually removed from the filaments, and into the hot wash.

The filaments may be left under tension during washing, although they may also be permitted to shrink.

After washing, the filaments, unless previously drawn, are drawn in the usual ratios, for example in a ratio of from 1:1.1 to 1:8, and dried, optionally after finishing. The moisture removed in the dryer may be condensed and advantageously reused for washing.

The process according to the invention may be used for removing virtually any known dry-spinning solvent. However, it is preferably used for removing dimethyl formamide.

In order to illustrate the connections between demoistening, water consumption, DMF content before washing, DMF content of the water used for washing and the effectiveness of washing, reference is made to FIG. 1 where the connections are illustrated in the case of a 6-stage cold wash.

Where washing is carried out in less than 10 minutes, it is only adhering solvent which can be removed by the cold wash, solvent present within the fibre remaining therein.

Figure 2:
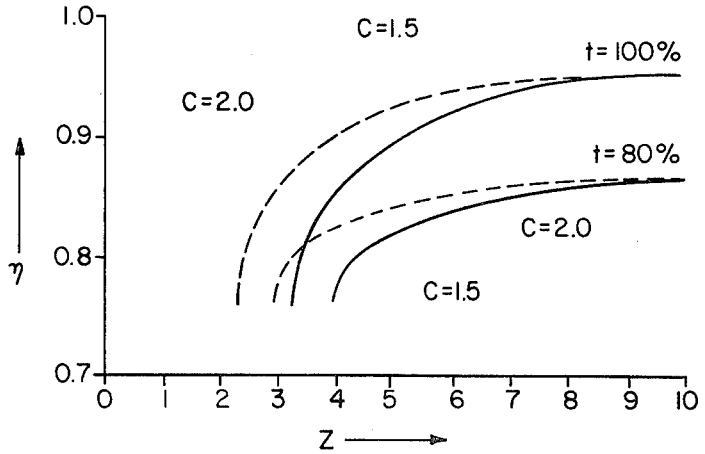

FIGS. 1 and 2 show the effectiveness of washing $$\eta_{an} = \frac{y_o - c\,y_n}{y_o}$$

in dependence upon the consumption of washing water. These Figures also show the DMF content of the water after washing ($y_l/y_o$).

In FIGS. 1 and 2:

$$\eta_{an} = \frac{y_o - c\,y_n}{y_o}$$

the degree of separation for adhering DMF $n$ = number of stages $y_o$ = DMF content of adhering moisture, based on the quantity of mixture $y_l$ = DMF content in the first washing stage, based on the quantity of mixture $y_n$ = DMF content in the last washing stage, based on the quantity of mixture $y_{n+l}$ = DMF content in the water used for washing, based on the quantity of mixture $Z$ = input of washing water based on the moisture adhering to the spun material, for example Z has the value 2 when spun material with a moisture of 30%, based on the fibre material, is washed with 60% of fresh water, based on the fibre material.

$c$ = demoistening index (quantity of moisture adhering after squeezing out to the quantity of moisture before washing): for example, the moisture before washing amounts to 30%, based on the dry tow, so C = 2 means that the moisture after squeezing out amounts to 60%, based on the dry tow.

The effectiveness of washing in dependence upon the consumption of water for various squeezing ratios and temperatures is shown in FIG. 2 for a 6-stage wash with a residence time per stage of 10 seconds. Since not only the adhering solvent, but also the solvent present in the PAN is removed during the hot wash, the overall deposition level $\eta_n$ is defined as $$\eta_n = \frac{P(x_o - x_n) + F(y_o - c \cdot y_n)}{P \cdot x_o + F \cdot y_o}$$

where $P$ = quantity of fibre weight in kg $F$ = quantity of moisture in kg before washing $x_o$ = DMF content in % by weight, based on fibre material before washing $x_n$ = DMF content in % by weight, based on fibre material after washing $y_o$ = DMF content of adhering moisture, based on the quantity of mixture $y_n$ = DMF content in the final washing stage, based on the quantity of mixture.

Taking into account the foregoing description, the process according to the invention may be carried out for example as follows:

A spun tow of an acrylonitrile (co)polymer with a dimethyl formamide content of from 10 to 40% by weight, wet- or dry-spun by conventional processes, is subjected to the washing treatment at a speed of travel of from 20 to 60 meters per minute. The tow is initially washed at room temperature over two to eight stages, the moisture content of the tow being reduced by squeezing out after each washing stage to between 30 and 50%, based on the dry weight of the fibres. After this cold wash, the tow is subjected to a 4- to 8-stage wash at a temperature of from 80° to 100° C., the residence time in this wash being from 60 to 90 seconds. Between the individual stages to tow is again squeezed out to a moisture content of from 30 to 50%. In each individual washing stage, the washing water reservoir is kept as small as possible (optionally by the addition of filling elements) because in this way the equilibrium condition corresponding to continuous working is adjusted more quickly, enabling much more uniform tows to be obtained. In this washing treatment, from 1 to 2.5 parts by weight of water per part by weight of the dry tow continuously flow in countercurrent to the tow, the washing solution in each individual washing stage being mixed with the washing agent flowing in from the following washing stage. The quantity of fresh water mentioned above is advantageously divided into two component streams, one of which is used for the final cold washing stage and the other for the final hot washing stage. However, it is also possible for the entire quantity of fresh water to be used for the final hot washing stage and for a single stream of washing water to flow in countercurrent to the tow, the tow optionally being cooled between the hot washing stages and the cold washing stages. The quantities of washing solution corresponding to the input of fresh water into the final stage are then continuously run off from the first washing stage. In the final stages of the washing process, the tow is best drawn to between 1.5 and 6 times its original length. The tow is then prepared and dried. It is advantageous to use a recirculating-air dryer and for the moisture removed from the tow to be condensed out of the air leaving the dryer by cooling and introduced into the washing process at that stage at which the DMF contents of the washing solution and the dryer condensate are substantially the same.

The fibres obtained in this way are distinguished by high tensile strength for high elongation at break, a low DMF content, high lustre stability and high density.

In the following Examples which are to further illustrate the invention without limiting it, all percentages are by weight unless otherwise indicated.

EXAMPLE 1

An acrylonitrile polymer consisting of 93.6% of acrylonitrile, 5.7% of methyl acrylate and 0.7% of sodium methallyl sulphonate was dissolved in dimethyl formamide at 90° C. The solution was dry-spun by conventional methods so that the spun material had a DMF content of 22%. The spun material was cold-washed in a cascade of nine stages. The washing liquid was thoroughly mixed in each stage. Between each stage, washing solution was removed from the tow by means of squeezing rolls. The tow, which had a weight of about 105 g per meter, entrained approximately 45% of moisture (based on the fibre weight) from one stage to the next. The washing water had a temperature of 15° C. and flowed in countercurrent to the tow from one stage to the next. In the ninth stage, 0.6 part of washing liquid (water with a DMF content of 0.1%) was added per part of PAN. After this treatment, the tow had a DMF content of 7%. Within the accuracy of measurement, this DMF content was independent of the speed of travel of the tow which was varied between 10 and 60 meters per minute. Even an increase in temperature in the washing liquid to 50° C. produced hardly any change in the DMF content. On completion of washing, the washing liquid had a DMF content of 33%. The tow then entered another cascade of 7 stages. This cascade was encassed so that neither DMF nor steam were emitted. In this cascade, the washing liquid had a temperature of 99° C.

The speed of travel of the tow was adjusted in such a way that, in each of the first six stages of the cascade (hot water), the residence time amounted to 10 seconds. Between each stage, washing liquid was removed from the tow by squeezing out to such an extent that 45% of washing liquid adhered to it. In this cascade, too, the washing liquid flowed in countercurrent to the tow. In the last stage, 0.9 part of water was added per part of PAN. On completion of hot washing, the washing liquid had a DMF content of about 6.8%. In the last stage, the tow was drawn in a ratio of 1:5. The tow had a DMF content before drawing of less than 1%. The tow was then prepared at 80° C., dried for one minute at 140° C. with allowance for shrinkage, and then crimped. The fibres had an individual denier of 3.3 dtex and a strength of about 3.7 p/dtex for an elongation at break of about 39%. The tow was split while still hot and processed into yarns. The yarns had a strength of 0.9 p/dtex for an elongation of 16%. The fibres contained very few vacuoles, had a stable lustre and a density of 1.18 g/cc.

EXAMPLE 2

The same spun material as in Example 1 was washed in the same stage cascade. The contact pressure of the squeezing rolls between the stages of the cold wash was reduced to such an extent that 60% of moisture, based on the quantity of fibres, was entrained. In order further to reduce the DMF content to 7% after cold washing, the consumption of water had to be increased to 0.9 part of water per part of PAN. On completion of washing, the washing liquid had a DMF content of about 25%. The tow was further treated in the same way as described in Example 1. The fibre and yarn values had the values observed in Example 1 within the limits of error.

EXAMPLE 3

When, by comparison with the first Example, the contact pressure of the squeezing rolls in the hot wash was reduced to such an extent that the tow entrained 60% of moisture, 1.2 parts of water had to be added per part of PAN in the final stage of washing in order to reduce the DMF content of the fibres to less than 1%. On completion of washing, the washing liquid had a DMF-content of about 5%. The tow was further treated in the same way as described in Example 1. The fibre and yarn values had the values observed in Example 1 within the limits of error.

EXAMPLE 4

When, in contrast to EXAMPLE 1, the tow was not subjected to a cold wash, it entered the hot 7-stage wash with a DMF-content of 22%. In order to reduce the DMF content of the fibres to 1%, 2 parts of water per part of PAN had to be added in the final stage of the hot wash. 0.4 part with a DMF content of about 1%, emanating from the dryer condensate, was added in the penultimate stage. Moisture removed from the tow in the dryer was deposited in a condenser and reused as washing liquid. 0.43 part of moisture with a DMF content of 1% was deposited per part of PAN. On completion of hot washing, the water had a DMF content of 10.3%. The tow was further treated in the same was as described in the first Example. The fibre and yarn values had the values observed in Example 1 within the limits of error.

EXAMPLE 5

When, by comparison with Example 4, the number of stages was increased by 6, only 1.5 as opposed to 2 parts of water per part of PAN had to be added in the final stage. On completion of washing, the washing liquid had a DMF content of 13.3%. The tow was further treated in the same way as described in Example 1. The fibre and yarn values had the values observed in Example 1 within the limits of error.

EXAMPLE 6

When, by comparison with Example 5, the speed of travel of the tow was doubled, the consumption of water amounted to 2 parts of water per part of PAN as in Example 4. On completion of hot washing, the water again had a DMF content of 10.3%.

What we claim is:

1. A process for continuously removing residual solvent from filaments of dry-spun acrylonitrile polymers to values of below 2% by weight of solvent, based on the dry filament material, which comprises washing the filaments in stages but with a total quantity of from 0.5 to 2.5 parts by weight of water per part by weight of the dry filament material, the water being at a temperature of at least 80° C., and the washing being carried out in countercurrent for at least 30 seconds.

2. The process of claim 1, wherein the filaments are washed over 6 to 24 stages.

3. The process of claim 1, wherein between the individual stages the moisture content of the filaments is reduced by 30 to 70% by weight by demoistening.

4. The process of claim 1, wherein the hot wash is carried out in a closed system.

5. The process of claim 1, wherein said solvent is dimethyl formamide.

6. The process of claim 4, wherein the filaments are washed with cold water before the hot wash.

* * * * *